US005246372A

United States Patent [19]

Campagnuolo et al.

[11] Patent Number: 5,246,372

[45] Date of Patent: Sep. 21, 1993

[54] TRAINING GRENADE

[75] Inventors: Carl J. Campagnuolo, Potomac, Md.; Donald Gross, Barstow; Wesley K. Clark, Ft. Irwin, both of Calif.

[73] Assignee: The United States of America as represented by the Secretary of the Army, Washington, D.C.

[21] Appl. No.: 608,923

[22] Filed: Nov. 5, 1990

[51] Int. Cl.[5] ..... F41A 33/00

[52] U.S. Cl. ..... 434/11; 434/24; 446/473; 446/398; 446/401; 446/405

[58] Field of Search ..... 446/473, 398, 401, 402, 446/405; 102/487; 434/11, 24; 273/416

[56] References Cited

U.S. PATENT DOCUMENTS

| | | | |
|---|---|---|---|
| 3,369,486 | 2/1968 | Ronnstad | 434/11 |
| 3,540,136 | 11/1970 | Billingsley | 434/11 |
| 3,712,218 | 1/1973 | Fay | 102/70.2 |
| 3,728,947 | 4/1973 | Harnden et al. | 95/11.5 R |
| 3,878,639 | 4/1975 | Scheelar et al. | 434/11 |
| 3,941,058 | 3/1976 | Gawlick et al. | 102/487 |
| 3,958,168 | 5/1976 | Grundberg | 321/2 |
| 4,066,019 | 1/1978 | Mehnert | 102/70.2 R |
| 4,245,403 | 1/1981 | Hipp | 434/11 |
| 4,319,426 | 3/1982 | Lee | 46/200 |
| 4,421,319 | 12/1983 | Murphy | 273/416 |
| 4,461,117 | 7/1984 | Gott | 446/473 |
| 4,852,496 | 8/1989 | Campagnvolo | 102/322 |

FOREIGN PATENT DOCUMENTS

| | | | |
|---|---|---|---|
| 2007339 | 9/1978 | United Kingdom | 102/487 |

OTHER PUBLICATIONS

Department of The Army Field Manual No. Dec. 23-30, 1988, pp i-iv, 1-1 to 1-7, 1-18 to 1-19 and 5-6 to 5-7.

*Primary Examiner*—V. Millin
*Assistant Examiner*—Jennifer Doyle
*Attorney, Agent, or Firm*—Saul Elbaum; Frank J. Dynda; Guy M. Miller

[57] ABSTRACT

A training grenade uses a high intensity flash to simulate an explosion in a time delayed fashion when thrown and/or a sonic device such as a buzzer for indicating arming. Alternative means to simulate the explosion can include sonic devices or radio frequency sources. An internal power source and firing circuit connected to an internal timer control the activation of the indicator or flash upon closure of an externally controllable switch. The switch can be locked in an open position through the use of a release pin which closes upon removal of the pin or can be held open through the use of a pivotally attached safety lever as used in conventional grenades.

17 Claims, 7 Drawing Sheets

TRAINING GRENADE

RIGHTS OF THE GOVERNMENT

The invention described herein may be manufactured, used and licensed by or for the U.S. Government for governmental purposes without payment to us of any royalty thereon.

BACKGROUND OF THE INVENTION

1. Field of the Invention

The present invention relates generally to training grenade devices and more particularly to a military training grenade which uses a high intensity flash to simulate an explosion in a time delayed fashion when thrown and/or a sonic device such as a buzzer for indicating activation or arming.

2. Description of the Prior Art

To date there is no way for the military to train with grenades in a completely safe manner. Present training or practice grenades use black powder and pyrotechnic delays to simulate grenade operation. The simulation consists of a small puff of white smoke and a loud popping noise after a short delay upon its release. Because an explosive charge is involved there is always some measure of danger involved. Consequently, there has been a long standing need for realistic training or practice grenades that do not rely on explosive charges (e.g. black powder and pyrotechnic delays) to simulate their operation.

In U.S. Pat. No. 4,461,117, issued to Gott on Jul. 24, 1984, there is disclosed a grenade that activates a light bulb to flash upon impact with the ground or other rigid surface. While the device in Gott works well as a toy it fails as a realistic military training grenade for various reasons. The grenade must impact for the light bulb to activate and the impact must occur at its forward impacting surface. In addition, the grenade requires fin stabilizers to properly position the grenade for impact, and therefore cannot be shaped like common U.S. Army military type grenades. These characteristics make the grenade in Gott unsuitable for military use. There is also no mention or suggestion in providing a delayed operation from release or a means for indicating that the grenade has become activated.

SUMMARY OF THE INVENTION

Accordingly, it is an object of the present invention to provide a grenade that can be used as a military training device without the use of explosives.

It is another object of the present invention to provide a grenade that doesn't use explosives but exhibits operational characteristics similar to that of combat grenades.

It is still another object of the present invention to provide a grenade that is capable of indicating to the thrower that it has become activated.

The present invention incorporates a flash bulb (or other indicating means to simulate an explosion) and unique electronic circuitry into a transparent or translucent grenade housing which exhibits a delayed flash after activation. The use of a pull pin and switch arrangement provides soldiers with a realistic grenade for use in training operations. An optional safety lever pivotally attached to the grenade can be used to hold the switch open and provides activation of the grenade only after the grenade has been released from a soldier's grasp. An additional sonic or buzzer type device provides a mode by which the activation of the grenade can be readily determined by its audible signal. When the grenade is activated the audible signal turns on. Upon firing of the flash the sonic device can be turned off or kept on for a short duration.

BRIEF DESCRIPTION OF THE DRAWINGS

The foregoing and other objects, aspects, uses and advantages of the present invention will be more fully appreciated as the same becomes better understood when considered in connection with the following detailed description of the present invention and in conjunction with the accompanying drawings, in which.

DESCRIPTION OF THE PREFERRED EMBODIMENTS

Figure 1:
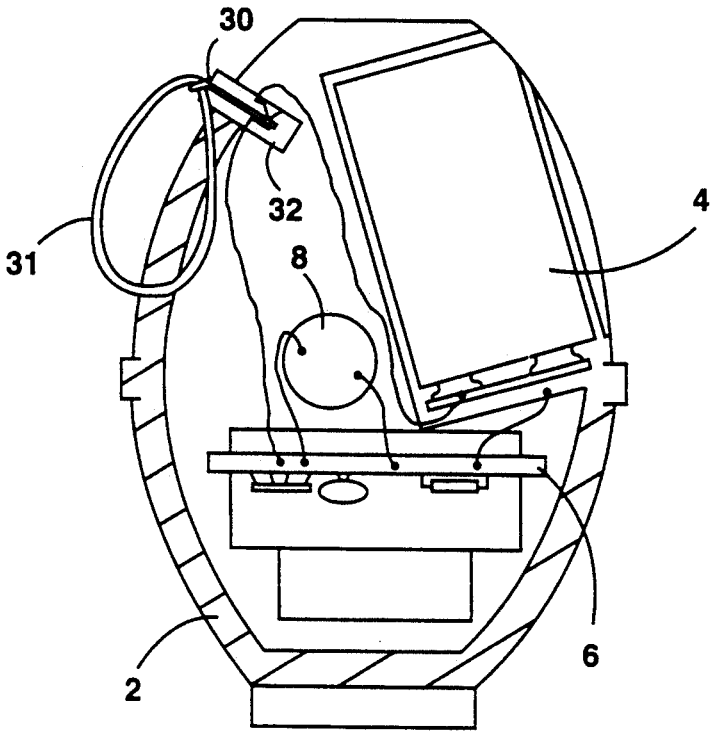
FIG. 1 shows a cross sectional view of a training grenade according to an aspect of the invention.

Referring now to the drawings, like reference numerals represent identical or corresponding parts throughout the several views.

A cross sectional view of a grenade 1, with a barrel shape as used in many fragmentation grenades, is shown in FIG. 1. The housing 2 is preferably made from a transparent or translucent, synthetic, flexible or shock resistant material. The grenade 1 contains a power supply or standard 9 volt battery 4 to power an electronic circuit mounted on circuit board 6 which fires a light emitting device 8. A sonic device or radio frequency transmitter may also be used in lieu of using a light emitting device 8. Any of these devices may be used to simulate the explosion of the grenade 1. Obviously, the grenade 1 need not be transparent or translucent if a sonic device or radio frequency transmitter is used as the indicating means. The preferred embodiment, however, employs a light emitting device 8 and is located in a hole inside the grenade so that when it flashes it illuminates the translucent housing 2 of the grenade 1. The light emitting device 8 could be, for example, a common type camera flash bulb such as a Sylvania Blue Dot, a light emitting diode, or a xenon flash beacon.

Figure 2:
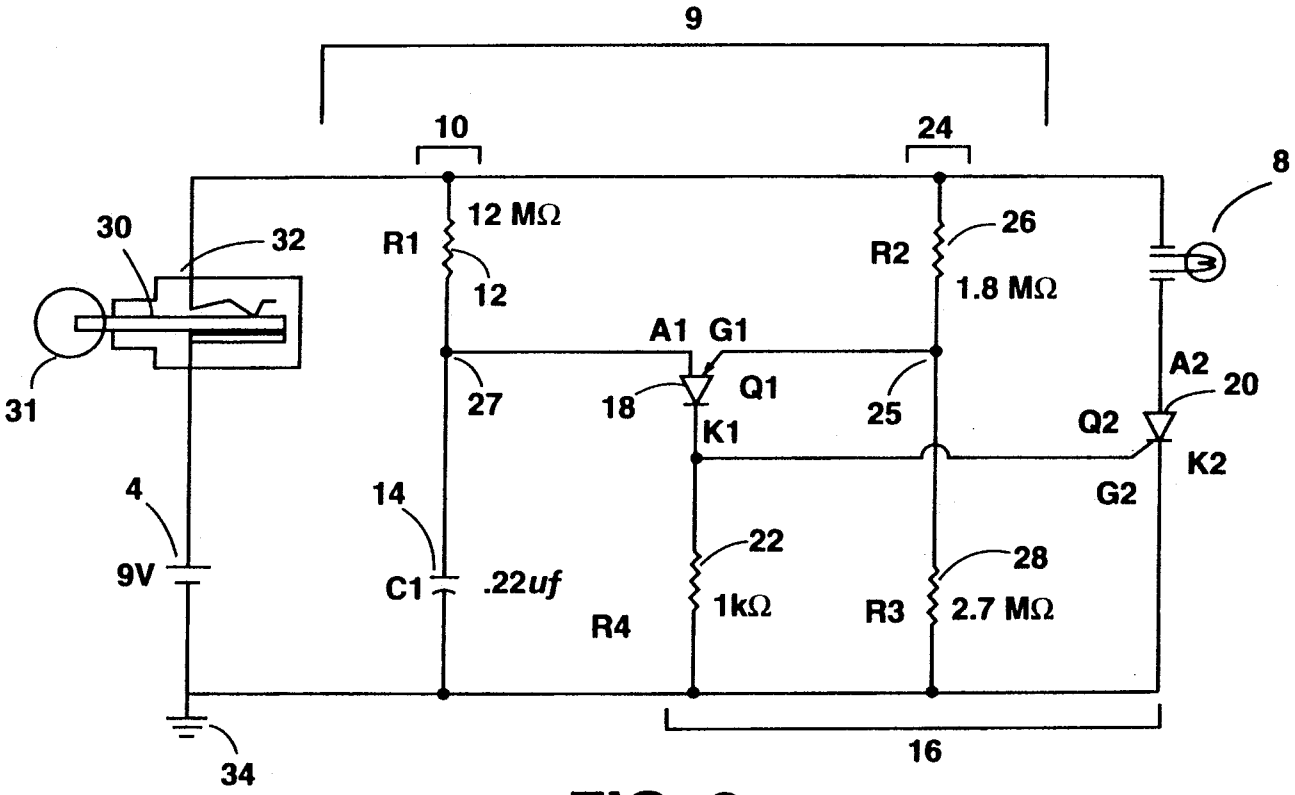
FIG. 2 shows an electrical schematic diagram of a basic embodiment of the invention.

The electronic circuit mounted on circuit board 6 is shown in schematic form in FIG. 2 and comprises a phone type switch 32, a flash bulb 8 and activation means 9. The activation means 9 comprises battery 4, a timing means 10 which may comprise a simple resistor 12 (R1) and capacitor 14 (C1) network, a firing circuit 16 which may comprise a programmable unijunction transistor (PUT-2N6028) 18 (Q1), a semiconductor controlled rectifier (SCR-2N4441) 20 (Q2) and a resistor 22 (R4), and a voltage divider network 24 which may comprise resistors 26 (R2) and 28 (R3) connected in parallel with the timing means 10. Upon removal of a safety pin 30, by pulling on a safety pin pull ring 31, the switch 32, in series combination with battery 4, closes. The removal of the safety pin 30 starts the charging of timing means 10 within the activation means 9. When the flash bulb 8 is activated by the firing circuit 16 it illuminates the translucent housing 2 thereby simulating an explosion.

The operation of the circuit shown in FIG. 2 is more specifically described as follows. After the safety pin 30 is removed and switch 32 closes voltage is applied across voltage divider network 24. The voltage developed at node 25 sets the gate (G1) voltage (firing threshold) on the PUT 18. At the same time capacitor 14 is charged via resistor 12 in timing means 10. The voltage at node 27 controls the anode (A1) voltage of PUT 18. The cathode (K1) of PUT 18 is connected to ground 34 through resistor 22. When the voltage at anode (A1) becomes greater than that at gate (G1) by the equivalent of a diode drop (0.6 volts) the PUT 18 switches and causes capacitor 14 to discharge into the gate (G2) of SCR 20. The cathode (K2) of SCR 20 is connected to ground 34. The discharge into gate (G2) causes SCR 20 to switch thereby completing a path to ground 34 for current to pass through the flash bulb 8. The time delay from the instant the pin 30 is pulled to the instant the flash bulb 8 fires is equal to the time required for the voltage at anode (A1) of PUT 18 to exceed that at gate (G1) by 0.6 V and is expressed by the equation:

$$V(A1) = V(G1) + .6$$

where $$V(A1) = V_B(1 - e - t/R_1C_1) = V_B(R2/R1 + R2) + .6$$

$$9(1 - e - t/2.64) = 9(2.7/4.5) + .6$$

$$t = 2.9 \text{ sec.}$$

Note that:

$$V(C_1) = V_B\left(\frac{R_2}{R_1 + R_2}\right)$$

and that for the above case a delay time of 3 seconds was chosen. That delay time can be controlled by choosing the components as given by the above equation.

Figure 3:
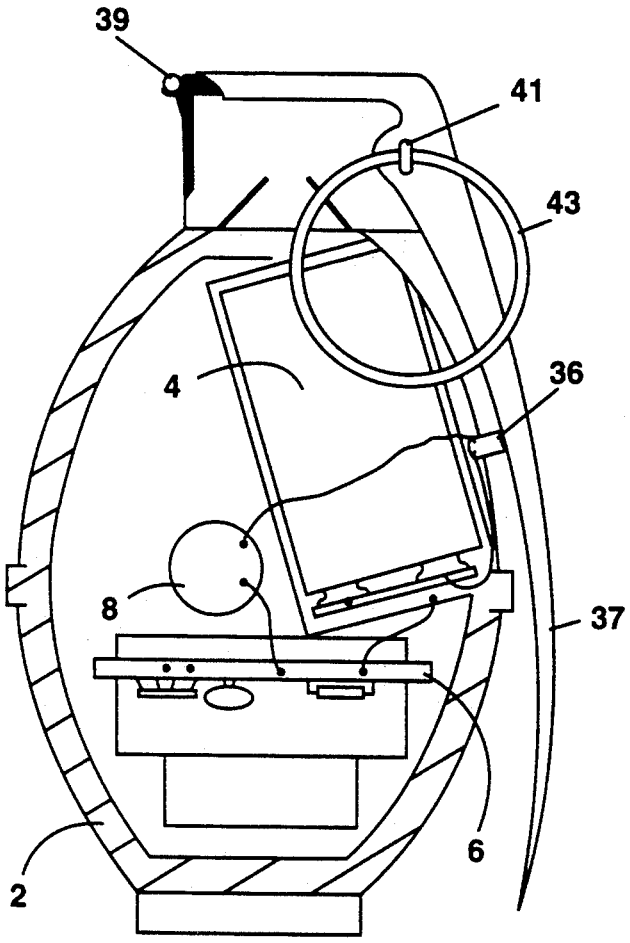
FIG. 3 shows a cross sectional view of a training grenade according to another aspect of the invention which employs a safety lever.

As previously discussed above, the removal of safety pin 30, which closes switch 32, will start the timing means 10. If the grenade 1 is not thrown within 3 seconds (or whatever time delay is chosen) the flash bulb 8 will flash. Another desirable mode of operation inhibits the start of the timing means 10 until the grenade 1 is actually released by a thrower. This embodiment is electronically identical to the schematic of FIG. 2 but replaces the phone type switch 32 with a push button micro switch 36 and includes a safety lever. Referring now to FIG. 3, a safety lever 37 is shown pivotally attached to the grenade 1 at lug 39 and is locked in a "safe" first position by safety pin 41. The micro switch 36 is physically held open by the safety lever 37 to prevent timing means 10 from starting. When safety pin 41 is removed by pulling on pull ring 43 safety lever 37 is permitted to pivot to a second position when released. When the grenade is released from a thrower's grasp switch 36 closes due to it being spring loaded. The circuit becomes completed and starts the timer 10.

Figure 4:
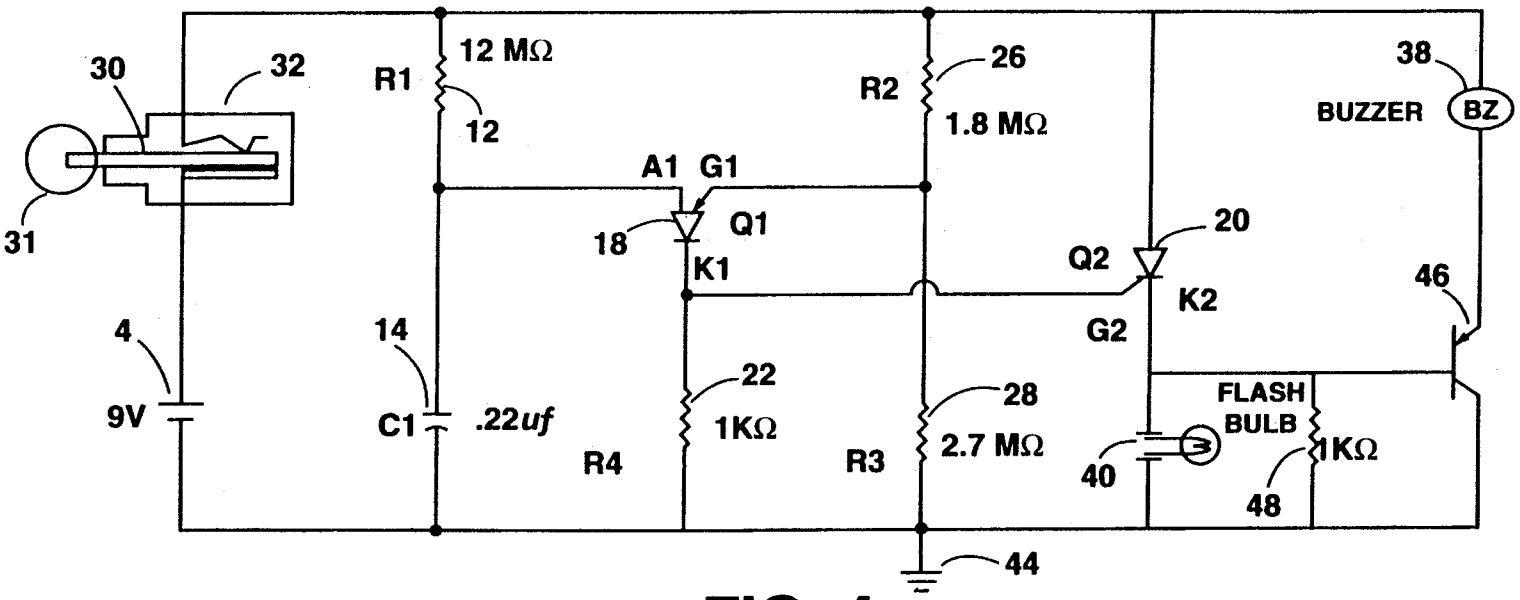
FIG. 4 shows an electrical schematic diagram according to an embodiment of the invention that employs a sonic or buzzer type device to indicate activation.

Another desirable feature is to indicate the instant the activation means 9 is supplied power or, in other words, to indicate when the grenade becomes active. Consequently, another embodiment of the present invention includes the use of a sound generator or buzzer 38 connected to a transistor 46 and resistor 48 as shown in FIG. 4. An Archer piezo buzzer model no. 273-074, 3-16 v is a suitable device. The activation means 9 remains the same as the previous embodiments. In this embodiment the buzzer 38 turns on at the instant pin 30 is pulled and switch 32 closes. The buzzer 38 transmits a predetermined set audible frequency. When the activation means 9 fires the flash bulb 40, which is now shown connected between the cathode (K3) of SCR 42 and ground 44, the buzzer 38 turns off. As discussed previously, with regard to FIG. 3, a micro switch 36 can be used in conjunction with a safety lever 37 to prevent activation of the circuit until the grenade 1 is released from the grasp of a thrower.

Figure 5:
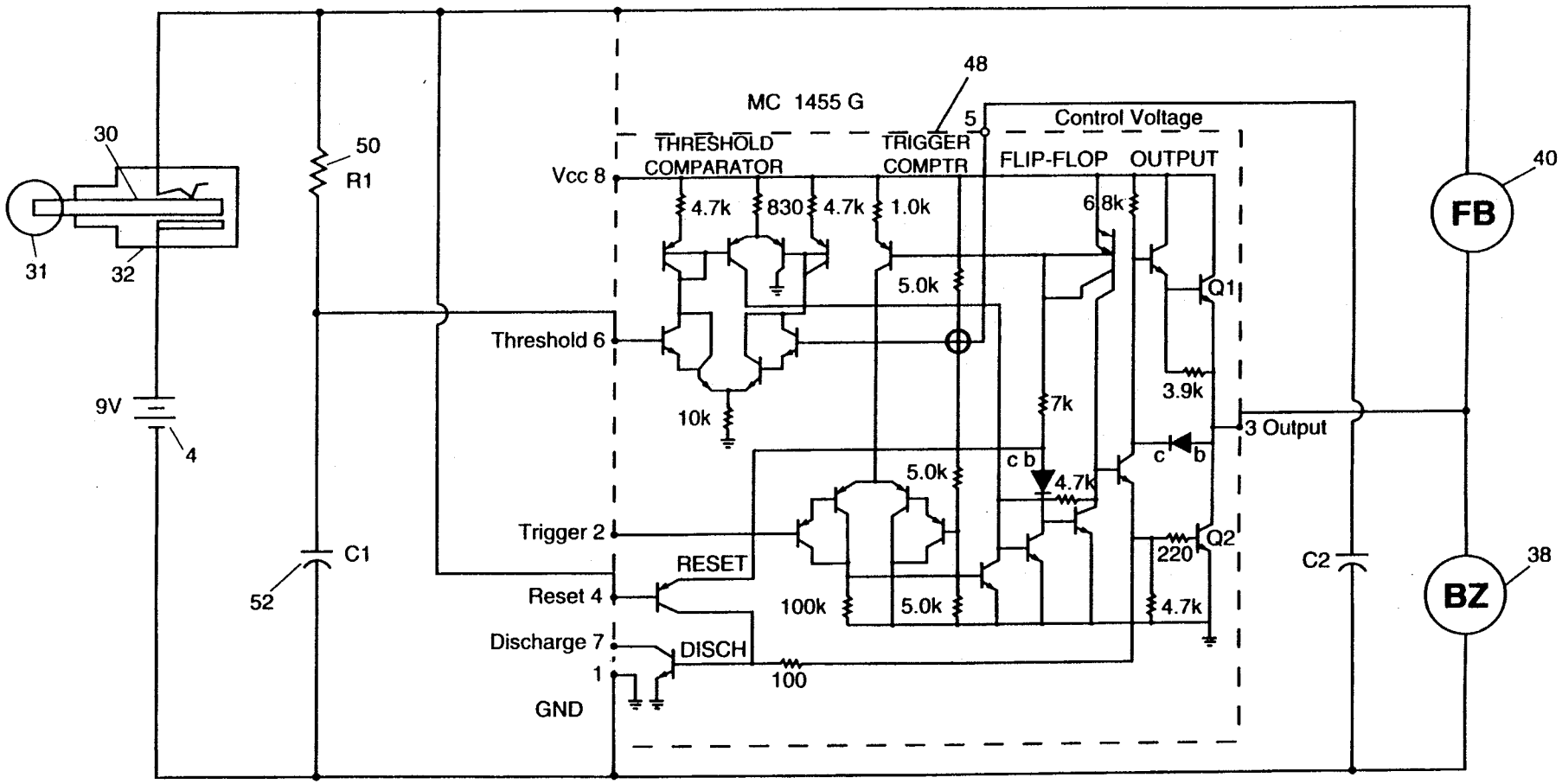
FIG. 5 shows an electrical schematic diagram of the circuit shown in FIG. 4 using an integrated circuit.

FIG. 5 shows an embodiment of the present invention employing a buzzer 38 in which the circuitry employs a Motorola MC1455 monolithic timing circuit 48. Timing is performed by one external resistor 50 and capacitor 52.

Figure 6:
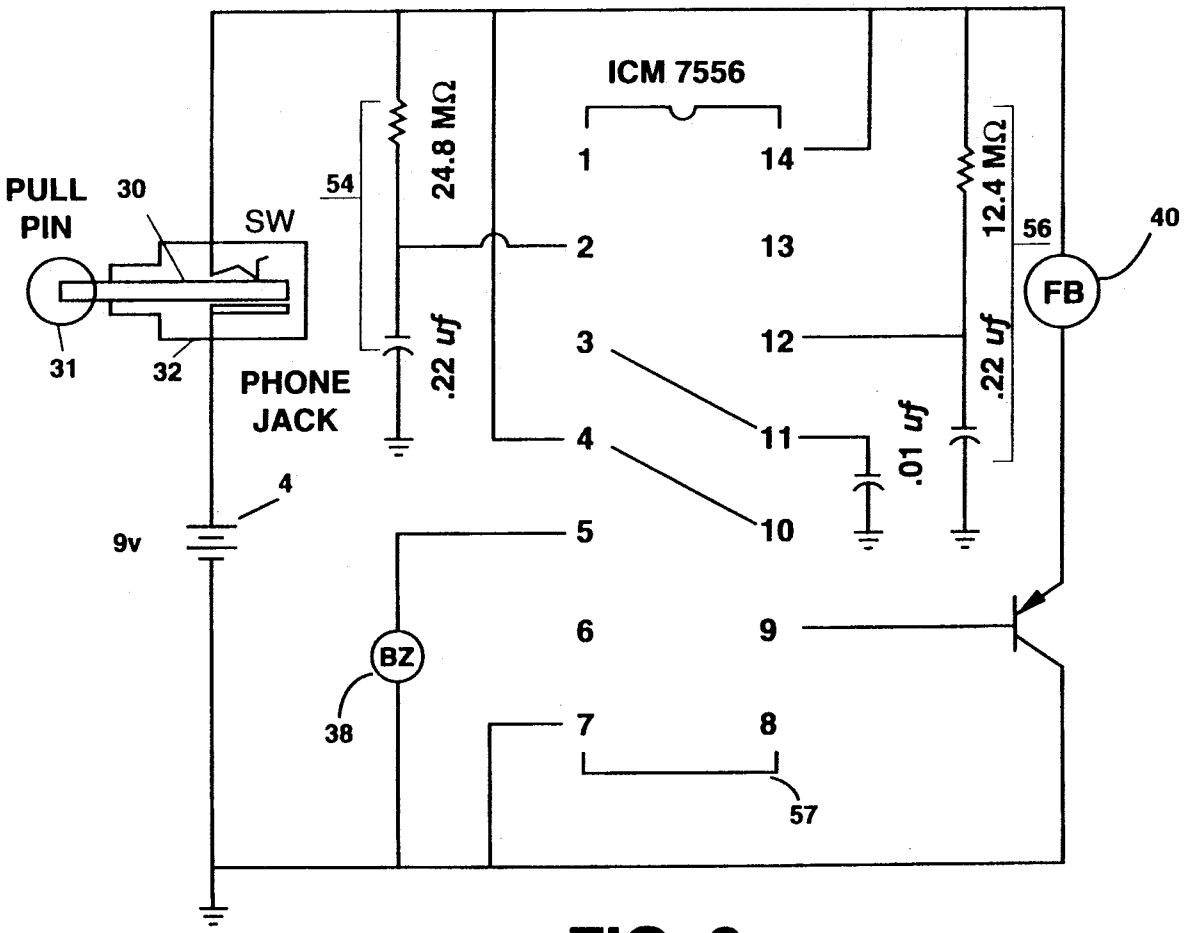
FIG. 6 shows an electrical schematic diagram of another embodiment of the invention that uses a sonic device to indicate activation and keeps the sonic device operating for a predetermined time after the indicator means is activated.

A still further embodiment of the present invention keeps the buzzer on for a period of time after the flash or indicator means has been activated. This mode simulates the presence of "fragments" through the use of the audible signal generated by the buzzer after the flash (i.e., explosion). As shown in the electronic schematic of FIG. 6, a dual monolithic timing circuit 57 (ICM7556) controls the on time for the buzzer 38 and time in which the flash bulb 40 flashes. In the embodiment shown the RC timing network 54 keeps the buzzer on for approximately 6 seconds after switch 32 closes. The RC timing network 56 is set to fire the flash bulb at approximately 3 seconds from closure of switch 32. Obviously, the component values may be selected to achieve the desired on times and delays.

Figure 7:
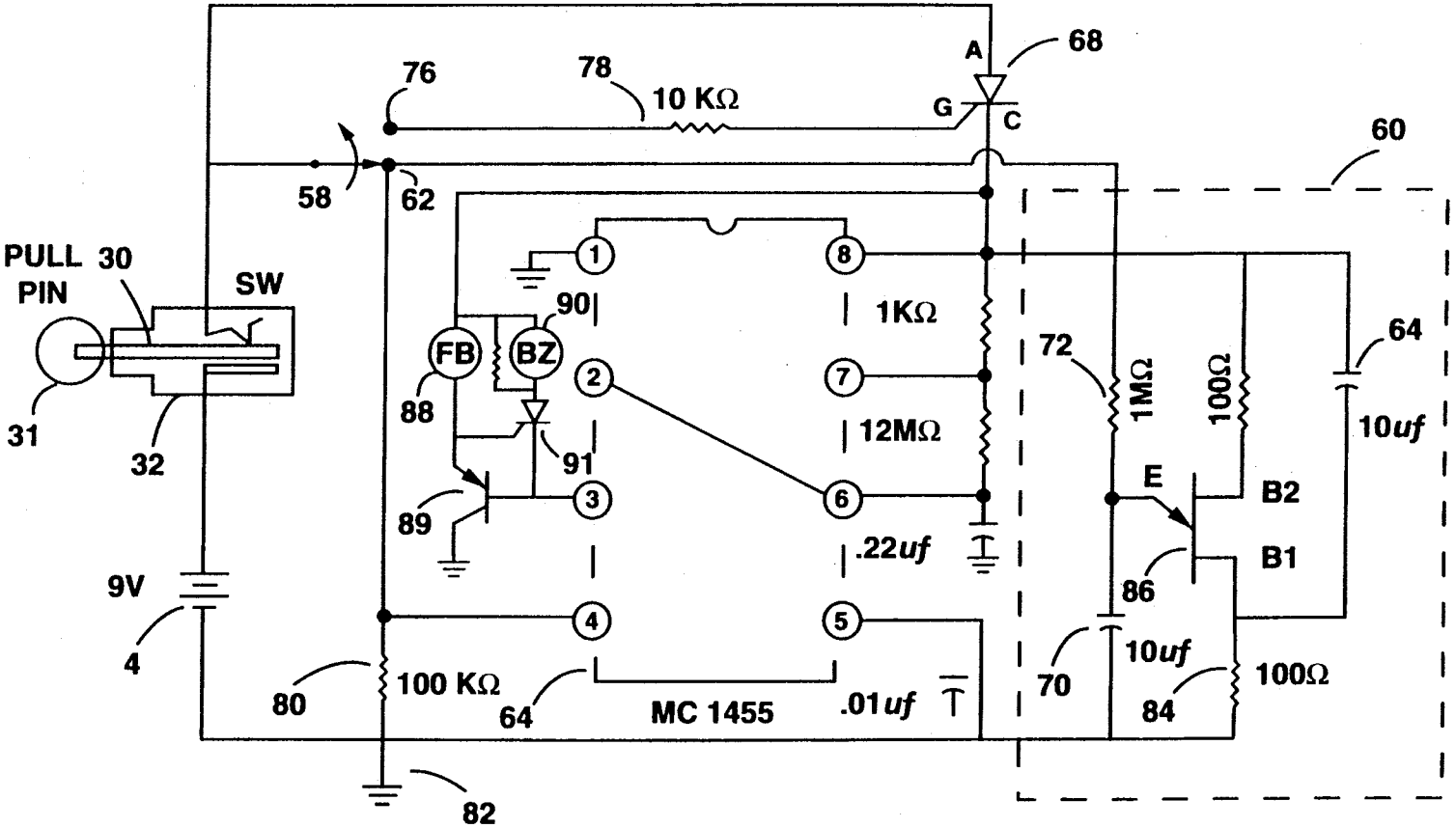
FIG. 7 shows an electrical schematic diagram of still another embodiment of the present invention that incorporates a power saving feature.

A final embodiment of the present invention employs a power saving feature so that the power supply is not drained while the grenade lies on the ground after being thrown. The embodiments described above exhibit the undesirable characteristic of draining the power supply even after the flash bulb or indicator means has been activated. FIG. 7 shows an electrical schematic that greatly reduces the current drain by including a power supply cut off feature. In addition, the sonic device now turns on after the indicator means activates. This embodiment includes a switch 58 and a current reducing means comprising SCR 68 and SCR turn off circuit 60.

The operation of the circuit of FIG. 7 is as follows. The pull pin 30 is controlled by pulling on pull ring 31 as shown in FIG. 1 while switch 58 may be a spring loaded push button type switch 36 as shown in FIG. 3. The grenade is normally in an "inactive" first condition. In the inactive state pull pin 30 is in and keeps the battery 4 disconnected from the the rest of the circuit. Switch 58 is in a normally closed position connecting node 62 to switch 32.

To operate the grenade pull pin 30 is first removed by the thrower and switch 58 is kept in its normally closed position, i.e., it is not pushed. When pull pin 30 is removed the battery 4 is connected to the circuit through node 62. Pin 4 of the integrated timer 64 becomes held at the battery voltage so that the reset PNP transistor (not shown) within the timer 64 becomes biased off for normal timer operation and SCR 68 remains off. Capacitor 70 charges to the battery voltage through resistor 72. No voltage is applied to capacitor 74.

The second step in the grenade operation requires the thrower to push switch 58 so that it is momentarily connected to node 76. SCR 68 is triggered on by the positive input pulse through resistor 78 into the gate of the SCR 68. As a result of triggering SCR 68, battery voltage is applied to the timer 64 at pin 8 and the SCR turn off circuit 60. Battery voltage is removed from pin 4 of the timer 64 thus making the timer inoperative. Capacitor 70 is discharged through resistors 72 and 80 to ground 82. Capacitor 74 charges through SCR 68 and resistor 84.

The third step in the grenade operation takes place when the thrower releases switch 58 so that it reconnects to node 62. This will occur when the thrower releases the grenade from his grasp. Battery voltage is applied to pin 4 of timer 64 for the timer sequence to start. After approximately a 3 second delay from releasing switch 58 the flash bulb 88 fires due to the signal on pin 3 going low turning on PNP transistor 89. The pulse generated due to the firing of flash bulb 88 on the gate of SCR 91 causes the buzzer 90 to turn on. The buzzer 90 then sounds for approximately 3 seconds until the signal on pin 3 goes high. Meanwhile, in the SCR turn off circuit 60, capacitor 70 charges through resistor 72 to the emitter peak-point voltage of unijunction transistor (UJT) 86. The component values shown give approximately a 10 second charge time. UJT 86 then conducts and discharges capacitor 70 through resistor 84 to ground 82. This action momentarily puts capacitor 70 and capacitor 74 in series (they were charged in parallel) and places the cathode of SCR 68 at a higher voltage than the anode. The SCR 68 becomes reversed biased reducing the SCR 68 current below the holding current value and shuts off the SCR 68. The circuit then reverts back to its condition before switch 58 was pushed to connect node 76 with battery 4. Consequently, capacitor 70 charges to the battery voltage through resistor 72 and pin 4 of timer 64 is held high. While the grenade lies on the ground current drain is negligible through resistor 80.

Obviously, numerous modifications and variations of the present invention are possible in light of the above teachings. It is therefore to be understood that within the scope of the appended claims, the invention may be practiced otherwise than as specifically described herein.

What is claimed is:

1. A grenade training device comprising:
a housing,
indicator means simulative of an explosion associated with said housing,
a switch operatively controlled externally to said housing, and
means responsive to closure of said switch for activating said indicating means after a predetermined time delay.

2. A grenade training device as defined in claim 1 wherein said indicator means comprises a light-emitting means for producing a flash visually simulative of the explosion associated with said housing.

3. A grenade training device as defined in claim 1 wherein said indicator means comprises a sound generator for generating a predetermined frequency sound.

4. A grenade training device as defined in claim 1 further comprising,
a release pin removably attachable from said housing which closes said switch upon removal.

5. A grenade training device as defined in claim 1 further comprising,
a release pin removably attachable from said housing,
a lever pivotally attached to said housing and locked in a first position by said release pin for holding said switch open where removal of said release pin permits said lever to pivot to a second position thereby closing said switch.

6. A grenade training device as defined in claim 1 comprising:
a battery connected in series with said switch,
means connected to said activating means and said battery for reducing current flow from said battery to said activating means after activation of said indicator means.

7. A grenade training device comprising:
a housing,
indicator means simulative of an explosion associated with said housing,
a switch operatively controlled externally to said housing,
means responsive to closure of said switch for activating said indicator means after a predetermined time delay, wherein said indicator means comprises a ratio frequency transmitter.

8. A grenade training device as defined in claims 2, 3, or 4 in which said activating means further comprises:
a power source,
timing means connected to said power source,
a voltage divider network connected in parallel with said timing means, and
a firing circuit connected to said indicator means and having a firing threshold set by said voltage divider, said firing circuit being triggered by said timing means.

9. A grenade training device as defined in claim 5 wherein said timing means comprises,
a resistor and capacitor in series combination.

10. A grenade training device comprising,
a housing,
indicator means simulative of an explosion associated with said housing wherein said indicator means comprises a light-emitting means for producing a flash,
a switch operatively controlled externally to said housing,
means responsive to closure of said switch for activating said indicator means after a predetermined time delay, said activating means comprising,
a power supply
timing means connected to said power supply,
a voltage divider network connected in parallel with said timing means,
a firing circuit connected to said indicator means and having a firing threshold set by said voltage divider, said firing circuit being triggered by said timing means and comprising,
a programmable unijunction transistor having its gate connected to said voltage divider and its annode connected to said timing means, and a silicon controlled rectifier having its gate connected to said programmable unijunction transistor.

11. A grenade training device as defined in claim 4 further comprising:

sound generation means responsive to said activating means upon closure of said switch and inhibited by said activation means upon activation of said indicator means.

12. A grenade training device comprising:

a housing, a voltage divider enclosed within said housing, timing means connected in parallel with said voltage divider, activation means set by said voltage divider and triggered by said timing means, a power supply, a switch connected in series combination with said power supply, the series combination connected in parallel across the parallel combination of said voltage divider and said timing means, a release pin removably attachable from said housing which closes said switch upon removal from said housing, sound generation means connected to the series combination of said switch and said power supply for generating a predetermined frequency sound upon removal of said release pin and is inhibited by said activation means, and indicator means connected to the series combination of said switch and said power supply and responsive to said activation means, whereby upon removal of said release pin said sound generation means generates a predetermined frequency sound and after a predetermined time said timing means triggers said activation means to energize said indicator means and turn off said sound generation means.

13. A grenade training device as defined in claim 10, or 12 further comprising:

means connected to said activating means and said power supply for reducing current flow from said power supply to said activating means after activation of said indicator means, wherein said current reducing means comprises:

a silicon controlled rectifier having its anode connected to said power supply, and means connected to said silicon controlled rectifier whereby said silicon controlled rectifier turns off.

14. A grenade training device as defined in claims 7, 10 or 12 wherein said housing is barrel shaped, translucent, and flexible.

15. A grenade training device as defined in claim 13 wherein said housing is barrel shaped, translucent, and flexible.

16. A grenade training device comprising:

a housing, indicator means simulative of an explosion associated with said housing, a switch operatively controlled externally to said housing, means responsive to closure of said switch for activating said indicating means after a predetermined timed delay, wherein said indicator means comprises a light-emitting means for producing a flash visually simulative of the explosion associated with said housing, and sound generation means responsive to said activating means upon closure of said switch and inhibited by said activation means upon activation of said indicator means.

17. A grenade training device comprising:

a housing, indicator means simulative of an explosion associated with said housing, a switch operatively controlled externally to said housing, means responsive to closure of said switch for activating said indicating means after a predetermined time delay, a voltage divider enclosed within said housing, timing means connected in parallel with said voltage divider, activation means set by said voltage divider and triggered by said timing means, a battery, a release pin removably attachable from said housing for closing said switch upon removal from said housing, a second switch connected in series combination with said switch and said battery being externally accessible to said housing said second switch closure controlled externally to said housing, the series combination connected in parallel across the parallel combination of said voltage divider and said timing means, and indicator means connected to the series combination of said switch and said second switch and said battery and responsive to said activation means, whereby upon removal of said release pin, which closes said switch, and closure of said second switch said activation means energizes said indicator means after a predetermined time period according to said timing means.

* * * * *